US007177561B2

(12) United States Patent
Serita

(10) Patent No.: US 7,177,561 B2
(45) Date of Patent: Feb. 13, 2007

(54) METHOD AND APPARATUS FOR REGULATING DEW FORMATION INSIDE AN IMAGE FORMING APPARATUS

(75) Inventor: Nobuhito Serita, Chiba-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 85 days.

(21) Appl. No.: 11/094,160

(22) Filed: Mar. 31, 2005

(65) Prior Publication Data

US 2006/0222385 A1 Oct. 5, 2006

(51) Int. Cl.
*G03G 15/00* (2006.01)

(52) U.S. Cl. ..... 399/44

(58) Field of Classification Search ..... 399/44, 399/97, 92

See application file for complete search history.

(56) References Cited

U.S. PATENT DOCUMENTS 5,138,379 A * 8/1992 Kanazashi ..... 399/44
5,530,523 A * 6/1996 Kawabata ..... 399/44
5,539,500 A * 7/1996 Hamamichi et al. ..... 399/97
6,463,226 B2 * 10/2002 Kitajima et al. ..... 399/44

FOREIGN PATENT DOCUMENTS

JP 08087228 A * 4/1996
JP 11-038861 A 2/1999
JP 2004013015 A * 1/2004

* cited by examiner

*Primary Examiner*—Susan Lee
(74) *Attorney, Agent, or Firm*—Foley & Lardner LLP

(57) ABSTRACT

A method for regulating dew formation on a photosensitive drum in an image forming apparatus comprises detecting the surface temperature of the photosensitive drum, detecting the internal temperature of the image forming apparatus and detecting the internal humidity of the image forming apparatus. A dew point is calculated and it is determined whether the surface temperature is higher than the dew point. If the surface temperature is lower than the dew point then the operation state one or more components within the image forming apparatus is adjusted to regulate dew formation. However, if the surface temperature remains higher than the sum of the dew point and the threshold value, normal operation is maintained.

26 Claims, 6 Drawing Sheets

METHOD AND APPARATUS FOR REGULATING DEW FORMATION INSIDE AN IMAGE FORMING APPARATUS

FIELD OF INVENTION

The present invention relates generally to image processing and more particularly to a system and method for regulating dew formation inside an image forming apparatus.

BACKGROUND OF THE INVENTION

Generally, when an image forming apparatus is turned on, it initiates a warm-up cycle. During warm-up, various internal components such as a photosensitive drum or a cooling fan are powered on. For example, air from the room in which the image forming apparatus is located may be drawn inside the image forming apparatus by a fan. Simultaneously, a fixing unit may become operational. Both the fan and fixing unit generate heat once they begin to operate.

Depending on several environmental factors, dew may be present on the photosensitive drum at warm up. Generally, dew is the formation of moisture on cool surfaces. This is an undesirable condition because dew on the photosensitive drum may lead to ink smudging and the production of defective images during the reproduction of an image.

Generally, to eliminate dew formation on the photosensitive drum, a heater is provided that heats the photosensitive drum when the temperature inside the image forming apparatus is lower than the temperature outside the image forming apparatus.

In addition, a fan may be used to warm the drum. The fan is controlled by a system that detects the difference between the temperature inside and outside the image forming apparatus. When the temperature difference equals a certain value, the fan is turned on to warm the drum.

While this process is somewhat effective, it fails to take into account the humidity present inside the image forming apparatus. Humidity is the measure of water vapor in the air. Accordingly, humidity is a major factor relating to the formation of dew on the photosensitive drum.

The conditions necessary for dew to form on the photosensitive drum depend upon the surface temperature of the photosensitive drum and the internal temperature and humidity near the drum. Thus, whether dew will form on the photosensitive drum during warm-up is not accurately determined by relying solely on the difference in temperature inside and outside an image forming apparatus.

Accordingly, an accurate system is needed to predict whether dew will form on the photosensitive drum. Further, a system and method is needed to warm-up an image forming apparatus such that dew is not formed on the photosensitive drum after the image forming apparatus has completed its warm-up cycle.

SUMMARY OF THE INVENTION

Briefly, in one aspect of the invention, an apparatus and method for regulating dew formation on a photosensitive drum in an image forming apparatus includes detecting the surface temperature of the photosensitive drum, detecting the internal temperature of the image forming apparatus and detecting the internal humidity of the image forming apparatus. In addition, a dew point is calculated and a determination is made if the surface temperature is higher than a sum of the dew point and a threshold temperature value. If the surface temperature is lower than the dew point, then the operation state one or more components within the image forming apparatus is adjusted to regulate dew formation.

Further features, aspects and advantages of the present invention will become apparent from the detailed description of preferred embodiments that follows, when considered together with the accompanying drawing figures.

DETAILED DESCRIPTION OF THE PREFERRED EMBODIMENTS

Figure 1:
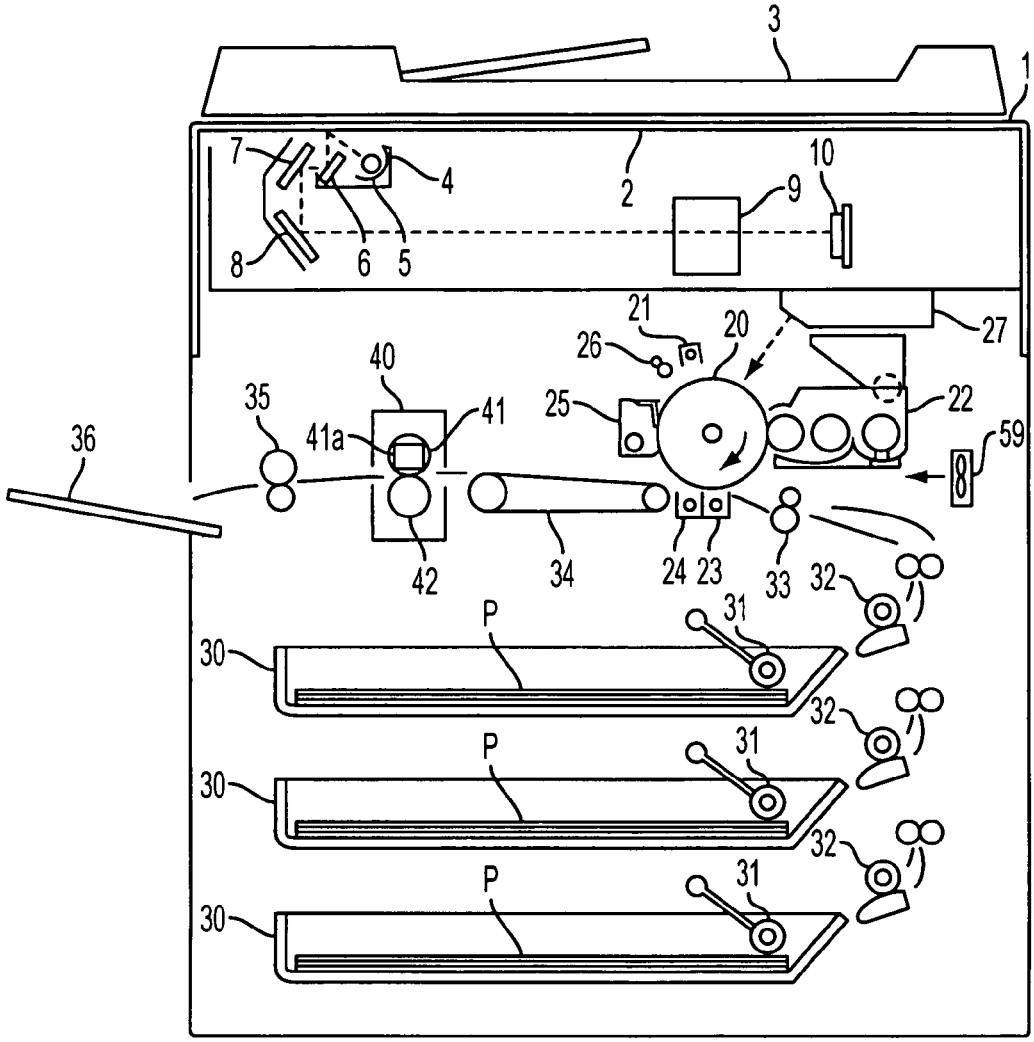
FIG. 1 is a side view of an image forming apparatus consistent with the present invention.

FIG. 1 shows a structural diagram of an image forming apparatus consistent with the present invention. As shown in FIG. 1, a document table 2 for placement of a page of a document is provided at an upper part of a main body 1. An automatic document feeder 3 is provided on the document table 2. The automatic document feeder 3 automatically feeds pages of the document one sheet at a time onto the upper surface of the document table 2.

A carriage 4 is reciprocally and movably provided on the lower side of the document table 2. An exposure lamp 5 is provided on the carriage 4. The carriage 4 is reciprocally moved while the exposure lamp 5 is being turned on. Thus, the entire surface of the document table 2 is exposed and scanned.

The exposure scan obtains a reflection light image of the document page on the document table 2. The reflection light image is projected on a charge-coupled device (CCD) line sensor (CCD sensor) 10 via reflection mirrors 6, 7 and 8 and a magnification-variable lens block 9. The CCD sensor 10 outputs an image signal of a voltage level corresponding to a reception light amount. The image signal is supplied to a laser unit 27. The laser unit 27 emits a laser beam corresponding to the image signal.

A photosensitive drum 20 is rotatably provided within the main body 1. The photosensitive drum 20 is successively surrounded by an electrifying charger 21, a developing unit 22, a transfer charger 23, a separating charger 24, a cleaner 25, and a destaticizer 26. The laser beam emitted from the laser unit 27 is passed between the electrifying charger 21 and developing unit 22 and strikes the peripheral surface of the photosensitive drum 20.

A plurality of sheet feed cassettes 30 are disposed at a bottom portion of the main body 1 and hold large amounts of copying sheets P serving as recording media. Each sheet feed cassette 30 is provided with a pick-up roller 31 for picking up copying sheets P one sheet at a time.

At the time of copying, copying sheets P are picked up one sheet at a time from any sheet feed cassette 30. A separator 32 separates the picked-up copying sheet P from the sheet feed cassette 30, and the paper is fed to a register roller 33. The copying sheet P waits in this area for rotation of the photosensitive drum 20, and in accordance with the timing rotating the photosensitive drum 20, the register roller 33 feeds the copying sheet P between the transfer charger 23 and photosensitive drum 20.

When the copying operation is performed, the photosensitive drum 20 rotates clockwise, as shown in FIG. 1. The electrifying charger 21 applies a high voltage supplied from a high voltage supply section (not shown) to the photosensitive drum 20, and electrifies the surface of the photosensitive drum 20 with electrostatic charge. An electrostatic latent image is formed on the photosensitive drum 20 by the electrification and the radiation of the laser beam from the laser unit 27 on the photosensitive drum 20.

The developing unit 22 supplies a developer to the photosensitive drum 20. With the supply of the developer, the electrostatic latent image on the photosensitive drum 20 is changed to a visible image. The transfer charger 23 transfers the visible image (developer image) from the photosensitive drum 20 onto the copying sheet P fed from the register roller 33. The copying sheet P with the transferred image is separated from the photosensitive drum 20 by the separating charger 24. The separated copying sheet P is brought to a fixing unit 40 by a conveyor belt 34.

The fixing unit 40 comprises a heating roller 41 and a pressing roller 42. The copying sheet P is inserted between both rollers, and while the copying sheet P is being conveyed, the developer image on the copying sheet P is fixed by the heat of the heating roller 41. The heat roller 41 is heated by a fixing heater 41*a*. The copying sheet P coming out of the fixing unit 40 is output to a tray 36 by conveyance rollers 35.

The heating roller 41 may be, for example, an endless member having a metal layer, which is constructed by an iron cylinder having a thickness of, for example, 1 mm. A mould-releasing layer of Teflon or similar material may be formed on the surface of the member. In addition, stainless steel, aluminum, an alloy of stainless steel or aluminum, or some other similar material may be used for the heating roller 41.

The pressing roller 42 may be constructed by coating elastic material such as silicon rubber, fluoro rubber, or some other similar material on the circumference of a core metal. The pressing roller 42 is pressed against the heating roller 41 at a predetermined pressure by a press mechanism, which provides a nip (where the outer circumferential surface of the pressing roller 42 is elastically deformed by a press contact) having a predetermined width at a position where both rollers contact each other. As a copying sheet P passes through the nip, toner on the copying sheet P is melted and fixed to the copying sheet P.

During the operation of the image forming apparatus, a temperature sensor, such as a thermistor, detects the temperature of the heating roller 41 of the fixing unit 40. The detected temperature of the heating roller 41, which corresponds to a fixing temperature for fixing the developer image to the copying sheet P, may be received by a main processing unit or processor, such as a CPU, which can serve as a control unit for controlling the operation of the components of the image forming apparatus.

Based on the detected fixing temperature, the main processing unit can generate control signals for adjusting the fixing temperature of the heating roller 41. For example, the CPU may enable a cooling fan 59 (see FIG. 3) if the temperature within the main body 1 is too high. A cooling fan 59 is operatively connected within the main body 1. The cooling fan 59, when enabled, can draw air from outside the main body 1 into the main body 1. Generally, this procedure lowers the temperature within the main body 1. The fixing temperature adjustment is also affected, in part, by the available supply of electric power to the fixing unit 40, and the heating roller 41 in particular. It should be recognized that various modifications or alternatives of the basic structure of the image forming apparatus may be achieved without departing from the basic relevant operation of the apparatus. The present invention is not limited to any particular structure.

Figure 2:
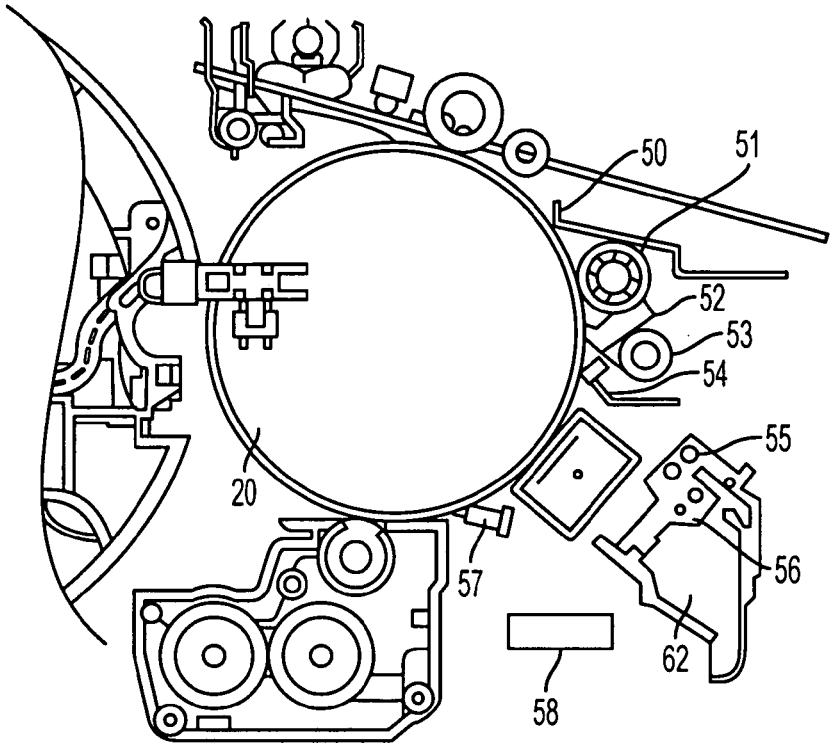
FIG. 2 is a sectional view of a photosensitive drum in an image forming apparatus consistent with the present invention

FIG. 2 is a sectional side view of the photosensitive drum 20 according to one aspect of the present invention. A recovery blade 50 is positioned above a drum cleaning brush 51, which is operatively connected to photosensitive drum 20. Positioned below the drum cleaning brush 51 is a detection sensor 52 that detects when the toner bag is full. Below the sensor, a toner collection auger 53 and a cleaning blade 54 are operatively connected to the photosensitive drum 20. An LED for electric discharge 55, an activating unit 56 for the automatic wire cleaner, and an exhaust duct for ozone 62 are operatively connected below the cleaning blade 54.

As shown in FIG. 2, in one aspect of the present invention, a surface detection sensor 57, for detecting the surface temperature of the photosensitive drum 20 is located close to the surface of the drum. The proximity of the surface detection sensor 57 allows for an accurate measurement of the drum surface temperature. Also shown in FIG. 2, a dual detection sensor 58 is positioned in close proximity to the photosensitive drum 20. The dual detection sensor 58 is capable of measuring the internal humidity and internal temperature within the main body 1 of the image forming apparatus. The dual detection sensor 58 can be an integrated element that detects both the internal humidity and the internal temperature, or it can be two separate elements with one element detecting internal humidity and the other detecting internal temperature. The proximity of the dual detection sensor 58 provides an accurate reading of the environmental conditions close to the photosensitive drum 20. Thus, based on the readings taken by the dual sensor 58 and the surface temperature sensor 57, an accurate prediction can be made as to whether dew has formed or will form on the photosensitive drum 20. The surface temperature sensor 57 and the dual sensor 58 may be operatively connected to a control unit, which in turn can generate control signals to adjust the environmental conditions within the main body 1 so that dew does not form on the photosensitive drum 20.

Figure 3:
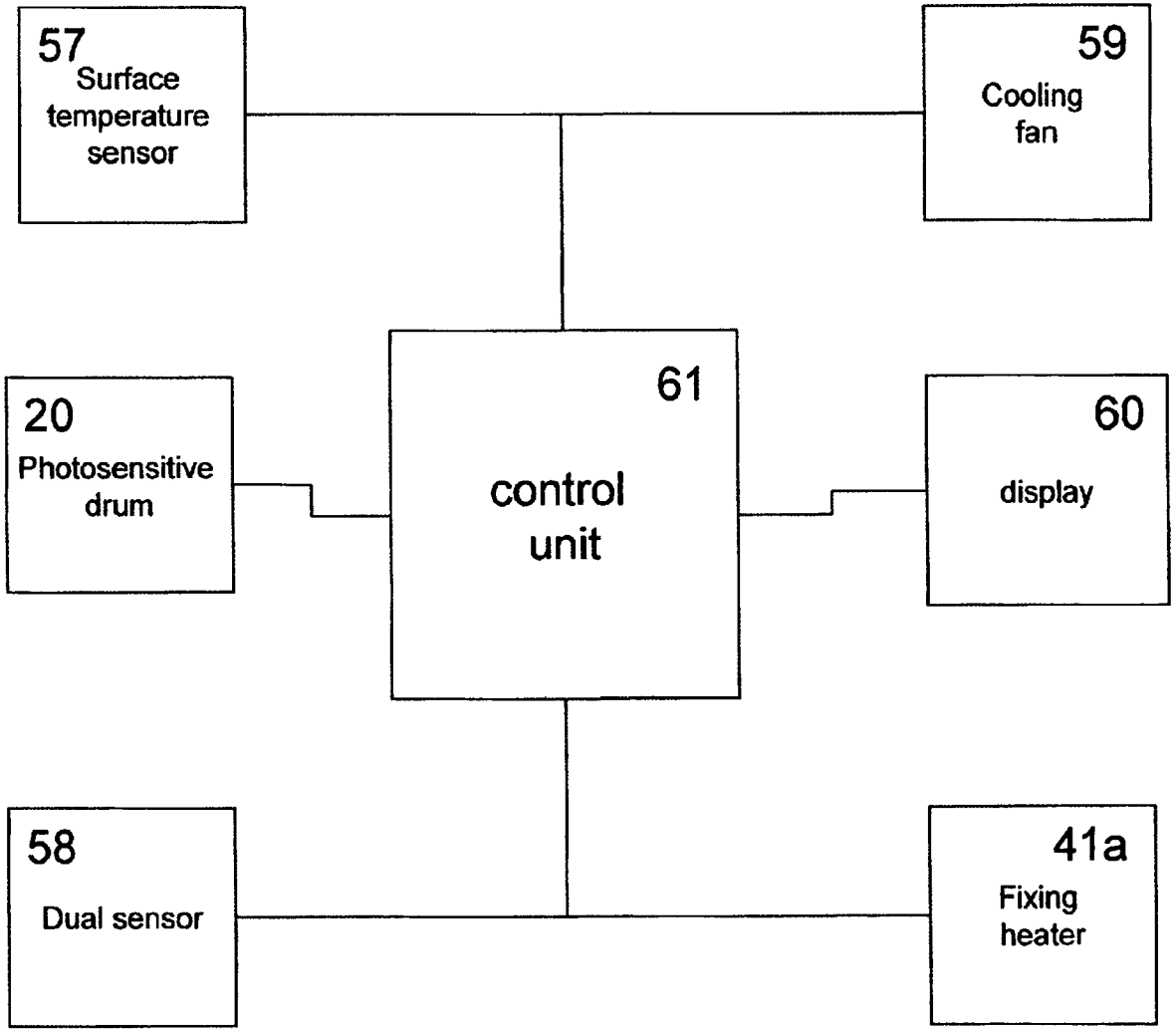
FIG. 3 is a block diagram of a system for dew regulation consistent with the present invention.

FIG. 3 is a block diagram of an image forming apparatus consistent with the present invention. As shown in FIG. 3, in one aspect of the present invention, a system for regulating dew formation in an image forming apparatus includes a surface temperature sensor 57, a photosensitive drum 20, a dual sensor 58 capable of detecting humidity and temperature, a cooling fan 59, a fixing heater 41*a*, a display 60 for displaying messages to a user, and a control unit 61. The control unit 61 is operatively connected to each component of the system as shown in FIG. 3 and may contain a CPU and memory. Based on the signals it receives, the control unit 61 may execute various functions as described below to enable or disable the operation of components within the image forming apparatus in order to regulate dew formation on the photosensitive drum 20.

Figure 4:
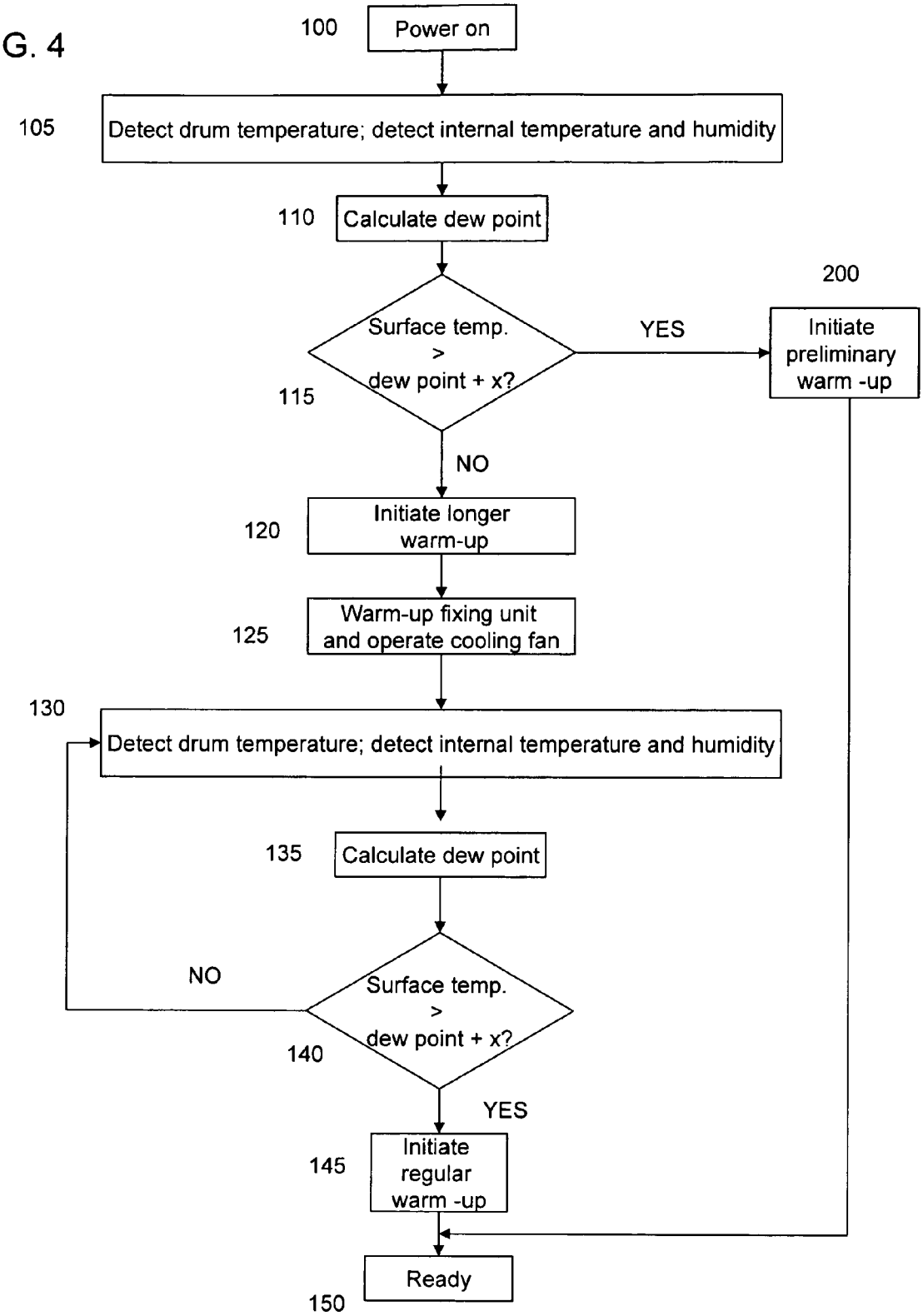
FIG. 4 is a flow diagram for a dew regulation process consistent with the present invention.

FIG. 4 is a flow diagram according to one aspect of the present invention. As shown in FIG. 4, the image forming apparatus is first powered on (step 100). In addition, the surface temperature of the photosensitive drum 20, as well as the internal temperature and the internal humidity of the image forming apparatus, is detected (step 105). The surface temperature can be detected by the surface temperature sensor 57, which can be implemented as a thermistor. The dual sensor 58 can detect the internal temperature and the internal humidity of the image forming apparatus. Preferably, the dual sensor 58 is implemented as one integrated sensor that is capable of measuring both the internal temperature and the internal humidity and is located in close proximity to the photosensitive drum 20.

The dew point is calculated (step 110). The dew point can be calculated using a dewing temperature algorithm based on the detected internal humidity and internal temperature. Preferably, the dew point is calculated in degrees Celsius using the following formula: T'(drum surface dew point)=T (internal temperature)+LN (percent humidity %/100)/0.061

For example, if the internal temperature is thirty degrees Celsius and the humidity is 60%, then the dew point equals 21.6 degrees Celsius. Thus, under these conditions, the surface of the photosensitive drum 20 can be warmed to 21.6 degrees Celsius or more to prevent dew formation on the drum 20.

Returning to FIG. 4, the apparatus determines whether the surface temperature is higher than the dew point (step 115). The surface temperature for the photosensitive drum 20 can be compared directly to the dew point, or a threshold value can be added to the calculated dew point and compared to the surface temperature. The threshold value is a predetermined amount of degrees. For example, in one aspect of the invention, the threshold value may be in the range of zero to five degrees Celsius. If the surface temperature is higher than the sum of the dew point and the threshold value, then the preliminary warm-up for the image forming apparatus is initiated (step 200). In the alternative, if the surface temperature is lower than the sum of the dew point and a threshold value, then there is a likelihood that dew may form on the surface of the photosensitive drum. Dew on the photosensitive drum may lead to poor operation, such as smudging. To regulate this behavior, the image forming apparatus initiates a longer warm-up. (Step 120).

When the longer warm-up is initiated, a message is displayed notifying the user of the image forming apparatus that a longer period of time will be required to warm up the apparatus. For example, the message may state, "Longer warming-up time is required since the inside of the body may dew." The apparatus warms up the fixing unit and powers on the cooling fan. In certain aspects of the present invention, the fixing unit may warm-up by rotating a fixing unit roller and powering on a fixing unit lamp. The heat generated from the operation of the fixing unit and cooling fan gradually increases the internal temperature of the image forming apparatus. Accordingly, the surface temperature of the photosensitive drum 20 may also increase, diminishing the chance of dew formation on the surface of the photosensitive drum. The surface temperature, internal temperature and internal humidity are again detected (step 130). Based on theses readings, the dew point is calculated (step 135). A comparison is again made between the surface temperature of the drum 20 and the calculated dew point (or the dew point and a predetermined threshold) (step 140). If the surface temperature is not higher than the dew point, the fixing unit and cooling fan continue to warm-up.

As the fixing unit and cooling fan continue to warm-up, the internal humidity, internal temperature and surface temperature are continuously monitored until the surface temperature is higher than the dew point. When the surface temperature becomes higher than the dew point, the likelihood of dew forming on the surface of the photosensitive drum is low. At that point, a regular warm-up of the image forming apparatus is initiated (step 145).

Regular warm-up of the image forming apparatus may include several steps not shown in the figure. However, in general, regular warm-up is initiated by rotating the photosensitive drum, powering on a developing unit and operating a conveyor belt 34. In addition, several other components of the image forming apparatus may be powered on and operated. Once the warm-up is complete, a ready message is displayed to the user (step 150).

Figure 5:
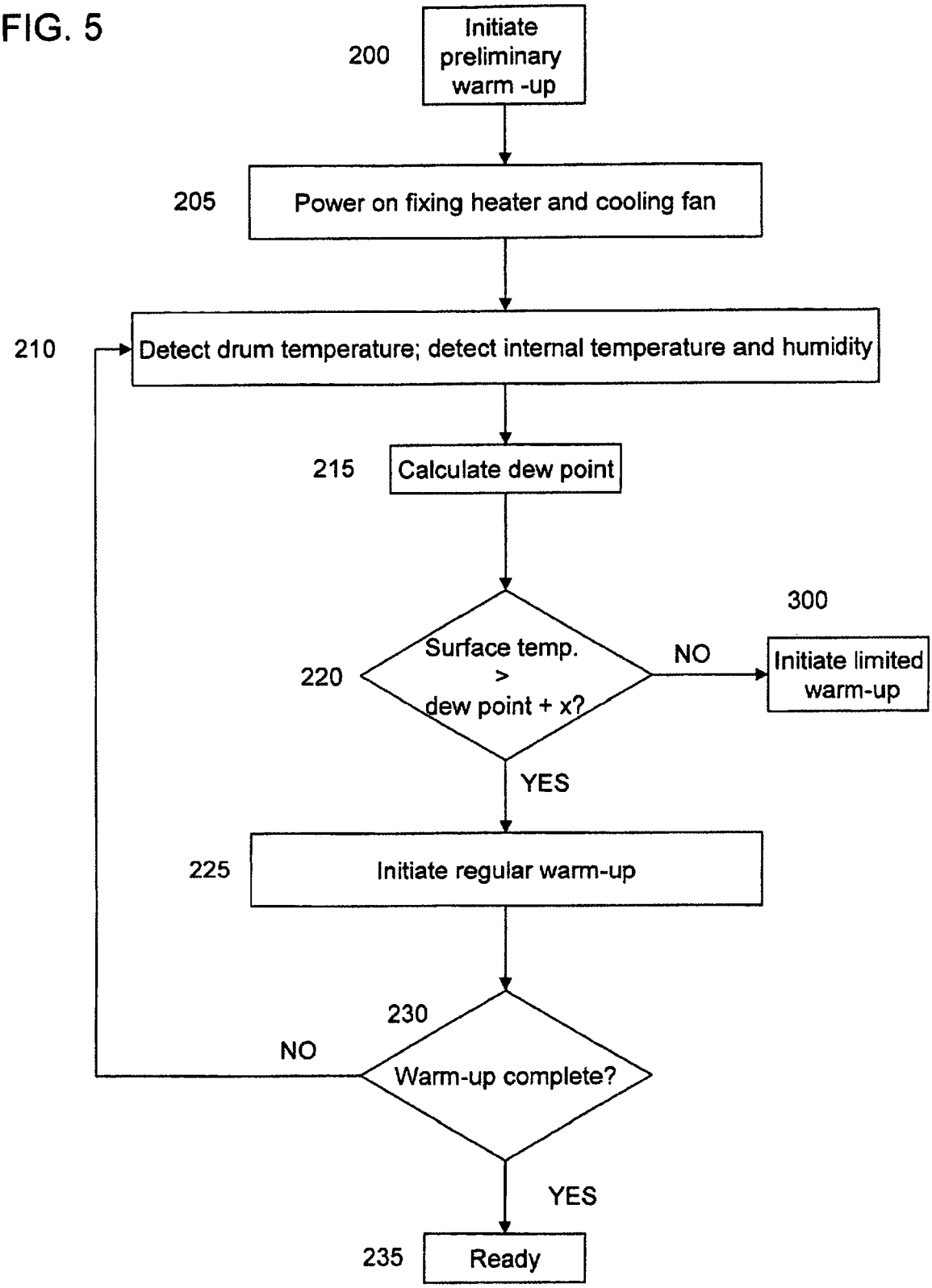
FIG. 5 is a flow diagram for a dew regulation process consistent with the present invention.

FIG. 5 is a flow diagram of the dew control process consistent with the present invention. As shown in FIG. 5, the preliminary warm-up is first initiated (step 200). The initial warm-up 200 begins with the fixing heater and cooling fan powering on (step 205). In addition, the internal temperature and internal humidity of the image forming apparatus and surface temperature of the photosensitive drum 20 are detected (step 210). The dew point is calculated based on these detected values (step 215). The apparatus determines whether the surface temperature of the photosensitive drum 20 is higher than the sum of the dew point and a threshold value (step 220). If the surface temperature is lower than the sum of the dew point and a threshold value then an incremental warm-up is initiated (step 300). In the alternative, if the surface temperature is higher than the sum of the dew point and a threshold value, then the image forming apparatus initiates a regular warm-up (step 225). The apparatus determines whether the regular warm-up is completed (step 230). When the regular warm-up is completed, a ready message is displayed to the user (step 235). In the alternative, if the warm-up is not complete, the image forming apparatus repeats steps 210 to 230.

Figure 6:
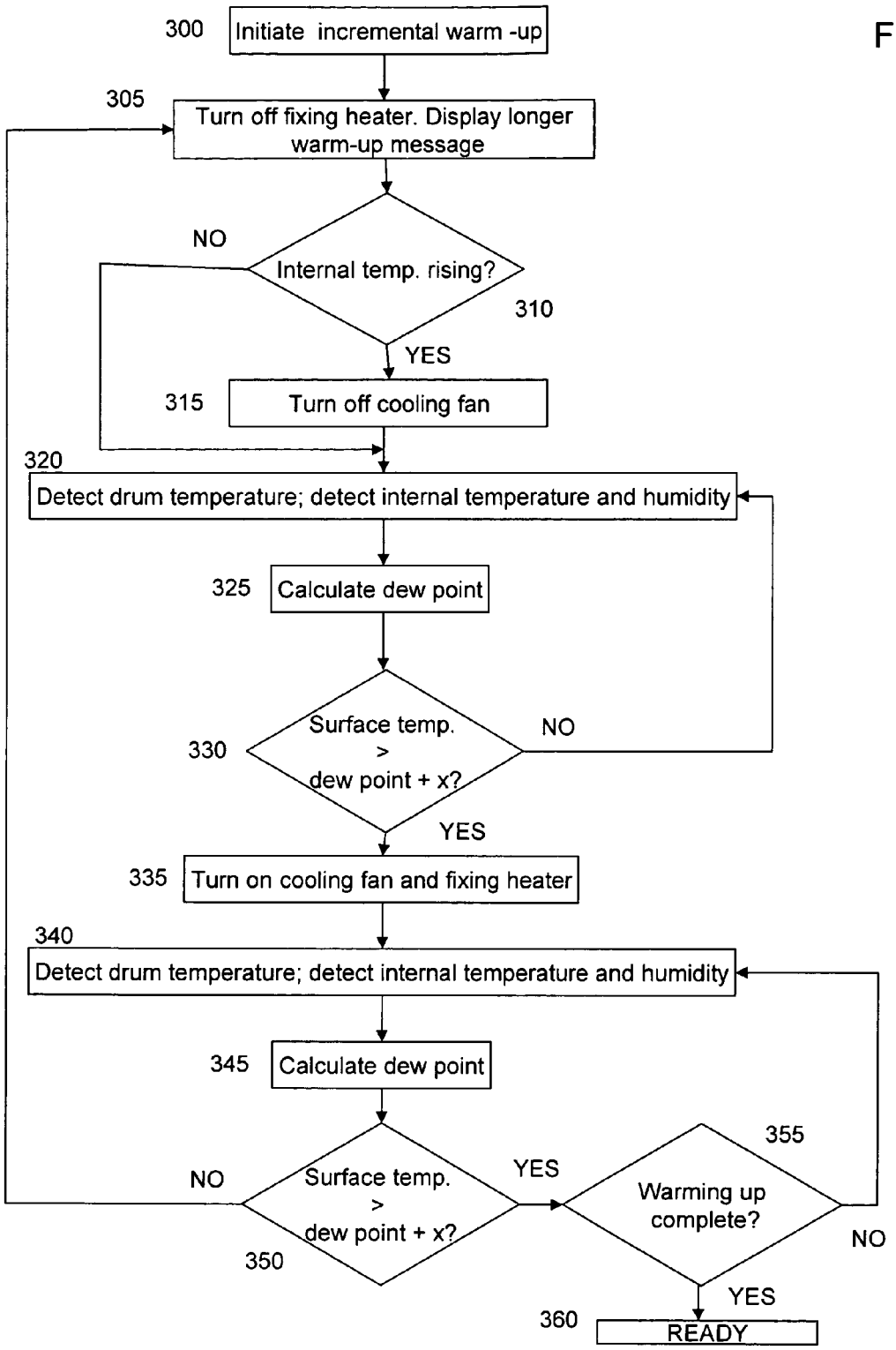
FIG. 6 is a flow diagram for a dew regulation process consistent with the present invention.

FIG. 6 is a flow diagram of the dew control process consistent with the present invention. As shown in FIG. 6, after the incremental warm-up is initiated (step 300), the fixing heater 41*a* is powered off and a message indicating that a longer warm-up time may be required is displayed to the user (step 305). The displayed message may state, "Longer warming-up time is required since the inside of the body may dew." This message may be displayed, for example, on a control panel of the image forming apparatus. Once the fixing heater 41*a* is powered off, the apparatus determines whether the internal temperature is still rising (step 310).

A rise in internal temperature after the fixing heater 41*a* is powered off may be due to operation of the cooling fan 59. In certain cases, the temperature of the air outside the image forming apparatus may be higher than the air inside the apparatus. When the cooling fan 59 operates, it takes air from outside the apparatus and blows that air inside the apparatus. In a case where the exterior air is at a higher temperature, the cooling fan 59, in effect, is blowing warmer air into the apparatus. This may cause the internal temperature to rise.

If the internal temperature rises after the fixing heater 41*a* is powered off, then the cooling fan 59 is powered off as well (step 315). If the internal temperature does not rise then cooling fan remains on. The internal temperature and internal humidity of the image forming apparatus and the surface temperature of the drum 20 are detected (step 320), and a dew point is calculated (step 325). The apparatus determines whether the surface temperature of the drum 20 is higher than the sum of the dew point and a threshold value (step 330). If the drum surface temperature is less than the sum of the dew point and a threshold value, the apparatus repeats steps 320 to 330, continuing to check the internal temperature and internal humidity of the image forming apparatus and the surface temperature of the drum 20.

If the surface temperature of the drum 20 is higher than the sum of the dew point and the threshold value, then fixing heater 41*a* and the cooling fan 59 are powered back on (step 335). In addition, the surface temperature of the drum 20 and the internal humidity and internal temperature of the image forming apparatus are detected (step 340), and a dew point is calculated (step 345). If the surface temperature is not higher than the sum of the dew point and a threshold value, then processing returns to step 305, and the fixing heater is turned off. In the alternative, if the surface temperature is higher than the sum of the dew point and the threshold value, then a determination is made of whether the incremental warm-up is completed (step 355). If the incremental warm-up is not completed, then step 340 and 345 are repeated. If the incremental warm-up is complete, a ready message is displayed to the user (step 360).

The foregoing description of a preferred embodiment of the invention has been presented for purposes of illustration and description. It is not intended to be exhaustive or to limit the invention to the precise form disclosed, and modifications and variations are possible in light in the above teachings or may be acquired from practice of the invention. The embodiment was chosen and described in order to explain the principles of the invention and as practical application to enable one skilled in the art to utilize the invention in various embodiments and with various modifications are suited to the particular use contemplated. It is intended that the scope of the invention be defined by the claims appended hereto and their equivalents.

What is claimed is:

1. A method for regulating dew formation on a photosensitive drum in an image forming apparatus, comprising:

detecting a surface temperature of the photosensitive drum;

detecting an internal temperature of the image forming apparatus;

detecting an internal humidity of the image forming apparatus;

calculating a dew point;

determining if the surface temperature is higher than the dew point; and if the surface temperature is lower than the dew point, adjusting an operation state of one or more components within the image forming apparatus to regulate dew formation.

2. A method according to claim 1, wherein the internal temperature and internal humidity are detected by a sensor located near the photosensitive drum.

3. A method according to claim 1, wherein the calculating step further comprises obtaining the dew point based on the detected internal temperature and internal humidity of the image forming apparatus.

4. A method according to claim 1, wherein the determining step includes determining if the surface temperature is higher than the sum of the dew point and a threshold temperature value.

5. A method according to claim 4, wherein the threshold temperature value is in the range of about zero to five degrees Celsius.

6. A method according to claim 1, wherein the adjusting step comprises warming-up a fixing unit and powering on a cooling fan.

7. A method according to claim 1, wherein the adjusting step comprises:

turning off a fixing heater;

turning off a cooling fan if the internal temperature rises after turning off the fixing heater; and continuing to operate the cooling fan if the internal temperature does not rise after turning off the fixing heater.

8. A method according to claim 1, further comprising:

initiating a preliminary warm-up if the surface temperature is higher than the dew point; and initiating a longer warm-up if the surface temperature is lower than the dew point.

9. A method according to claim 8, wherein the preliminary warm-up comprises:

powering on a fixing heater and a cooling fan in the image forming apparatus;

detecting the surface temperature of the photosensitive drum and the internal temperature and the internal humidity of the image forming apparatus after powering on the fixing heater and the cooling fan;

calculating the dew point based on the detected internal temperature and internal humidity;

determining if the surface temperature is greater than the dew point;

initiating an incremental warm-up if the surface temperature is lower than the dew point;

initiating a regular warm-up if the surface temperature is higher than the dew point;

determining if the regular warm-up is complete; and displaying a ready message to the user if the regular warm-up is complete.

10. A method according to claim 8, wherein the longer warm-up comprises:

displaying a message to a user indicating a longer warm-up time is required;

warming-up a fixing unit in the image forming apparatus;

powering on a cooling fan in the image forming apparatus;

detecting the surface temperature of the photosensitive drum and the internal temperature and the internal humidity of the image forming apparatus;

calculating a dew point based on the detected internal temperature and internal humidity;

determining if the surface temperature is higher than the dew point; and initiating a regular warm-up if the surface temperature is higher than the dew point.

11. A method according to claim 9, wherein the incremental warm-up comprises:

turning off the fixing heater;

displaying a message to a user indicating a longer warm-up time is required;

determining if the internal temperature rises after turning off the fixing heater;

turning off the cooling fan if the internal temperature rises after turning off the fixing heater;

continuing to operate the cooling fan if the internal temperature does not rise after turning off the fixing heater;

detecting the surface temperature of the photosensitive drum and the internal temperature and internal humidity of the image forming apparatus;

calculating a dew point based on the detected internal temperature and internal humidity;

determining if the surface temperature is higher than the dew point;

powering on the fixing heater and the cooling fan if the surface temperature is higher than the dew point;

detecting the surface temperature of the photosensitive drum and the internal temperature and internal humidity of the image forming apparatus;

calculating a dew point based on the detected internal temperature and internal humidity;

determining if the surface temperature is greater than the dew point;

repeating the turning off of the fixing heater if the surface temperature is lower than the dew point;

determining if the incremental warming-up is finished if the surface temperature is higher than the dew point; and displaying a ready message to the user if the incremental warm-up is complete.

12. A method according to claim 8, wherein the internal temperature and internal humidity are detected by a sensor located near the photosensitive drum.

13. A method according to claim 8, wherein the calculating step further comprises obtaining the dew point based on the internal temperature and internal humidity of the image forming apparatus.

14. A method according to claim 8, wherein the determining step includes determining if the surface temperature is higher than the sum of the dew point and a threshold temperature value.

15. A method according to claim 14, wherein the threshold temperature value is in the range of about zero to five degrees Celsius.

16. A method according to claim 10, wherein the regular warm-up comprises:

rotating the photosensitive drum;

powering on a developing unit; and enabling the operation of a conveyor belt.

17. A system for regulating dew formation inside an image forming apparatus, comprising:

a photosensitive drum;

a first detection sensor coupled to the photosensitive drum for detecting a temperature of the surface of the photosensitive drum; and a second detection sensor positioned near the photosensitive drum for detecting an internal humidity and internal temperature of the image forming apparatus.

18. A system according to claim 17, further comprising:

a fixing unit having a fixing heater;

a cooling fan; and a user display.

19. A system according to claim 18, wherein upon powering on, the system is configured to:

detect a surface temperature of the photosensitive drum;

detect an internal temperature of the image forming apparatus;

detect an internal humidity of the image forming apparatus;

calculate a dew point;

determine if the surface temperature is higher than the dew point; and if the surface temperature is lower than the dew point, adjust an operation state of one or more components within the image forming apparatus to regulate dew formation.

20. A system according to claim 19, wherein the adjustment to the operation state of one or more components includes warming-up the fixing unit and powering on the cooling fan.

21. A system according to claim 19, wherein the adjustment to the operation state of one or more components includes:

turning off the fixing heater;

turning off the cooling fan if the internal temperature rises after turning off the fixing heater; and continuing to operate the cooling fan if the internal temperature does not rise after turning off the fixing heater.

22. An image forming apparatus comprising:

a photosensitive drum;

a first detection sensor coupled to the photosensitive drum for detecting a temperature of the surface of the photosensitive drum; and a second detection sensor for detecting an internal humidity and internal temperature of the image forming apparatus positioned near the photosensitive drum.

23. An image forming apparatus according to claim 22, further comprising:

a fixing unit having a fixing heater;

a cooling fan; and a user display.

24. An image forming apparatus according to claim 23, wherein, upon powering on, the image forming apparatus is configured to:

detect a surface temperature of the photosensitive drum;

detect an internal temperature of the image forming apparatus;

detect an internal humidity of the image forming apparatus;

calculate a dew point;

determine if the surface temperature is higher than the dew point; and if the surface temperature is lower than the dew point, adjust an operation state of one or more components within the image forming apparatus to regulate dew formation.

25. An image forming apparatus according to claim 24, wherein the adjustment to the operation state of one or more components includes warming-up the fixing unit; and powering on the cooling fan.

26. An image forming apparatus according to claim 24, wherein the adjustment to the operation state of one or more components includes:

turning off the fixing heater;

turning off the cooling fan if the internal temperature rises after turning off the fixing heater; and continuing to operate the cooling fan if the internal temperature does not rise after turning off the fixing heater.

* * * * *